US008499406B2

(12) United States Patent
Fava

(10) Patent No.: US 8,499,406 B2
(45) Date of Patent: Aug. 6, 2013

(54) MICROFIBER SWEEP MOPCLOTH CLEANING DEVICE

(75) Inventor: Gina Marie Fava, Danielson, CT (US)

(73) Assignee: Gina Marie Fava, Danielson, CT (US)

( * ) Notice: Subject to any disclaimer, the term of this patent is extended or adjusted under 35 U.S.C. 154(b) by 931 days.

(21) Appl. No.: 12/284,090

(22) Filed: Sep. 17, 2008

(65) Prior Publication Data

US 2009/0144926 A1 Jun. 11, 2009

Related U.S. Application Data

(60) Provisional application No. 60/960,229, filed on Sep. 20, 2007.

(51) Int. Cl.
*A47L 13/44* (2006.01)

(52) U.S. Cl.
USPC ..... 15/247; 15/228

(58) Field of Classification Search
USPC ..... 15/228, 247
See application file for complete search history.

(56) References Cited

U.S. PATENT DOCUMENTS

| | | | | | |
|---|---|---|---|---|---|
| 960,158 | A * | 5/1910 | Cummings | 15/247 |
| 1,061,486 | A * | 5/1913 | McDonald | 15/247 |
| 1,080,572 | A * | 12/1913 | McDonald | 15/247 |
| 1,339,767 | A * | 5/1920 | Kelly | 15/247 |
| 2,288,592 | A * | 7/1942 | Mirhige | 15/247 |
| 2,293,461 | A * | 8/1942 | Gougeon | 15/247 |
| 2,709,824 | A * | 6/1955 | Hall | 15/247 |
| 2,815,521 | A * | 12/1957 | Winckler | 15/118 |
| 2,963,731 | A * | 12/1960 | Hoots | 15/247 |
| 3,166,775 | A * | 1/1965 | Cushman | 15/228 |
| 3,462,790 | A * | 8/1969 | Lingle | 15/247 |
| 3,938,570 | A * | 2/1976 | Stewart | 150/160 |
| 5,709,006 | A * | 1/1998 | Carter, Jr. | 15/247 |
| 6,389,637 | B1 * | 5/2002 | Hurell | 15/247 |
| 7,743,456 | B2 * | 6/2010 | McDonnell | 15/247 |
| 2003/0182751 | A1 * | 10/2003 | White | 15/244.3 |
| 2005/0160550 | A1 * | 7/2005 | Reeves | 15/247 |
| 2008/0089735 | A1 * | 4/2008 | Black et al. | 401/289 |

* cited by examiner

*Primary Examiner* — Randall Chin
(74) *Attorney, Agent, or Firm* — Gina Marie Fava

(57) ABSTRACT

The present invention relates to a microfiber sweep mopcloth cleaning device, is comprised of a receptacle member of a fabric strap loop along with a pair of Velcro® strips, permanently sewed into a square microfiber terry cloth and affixes and gives an adjustable custom fit to most any size, design, shape or angle of an ordinary nylon household broom, without the worry of shifting, twisting or falling off and ultimately keeps a broom a broom, only allocating the ability to sweep and wipe clean substances, wet, dry, gooey or otherwise on today's old and new surfaces, meticulously and with precision and accuracy like never before, eliminating multiple cleaning tools and supplies, saving time, money and the environment, ultimately bringing joy and making the task of housekeeping fun and addictive for everyone. "A gift for those who love to clean and one for those who have to."

6 Claims, 4 Drawing Sheets

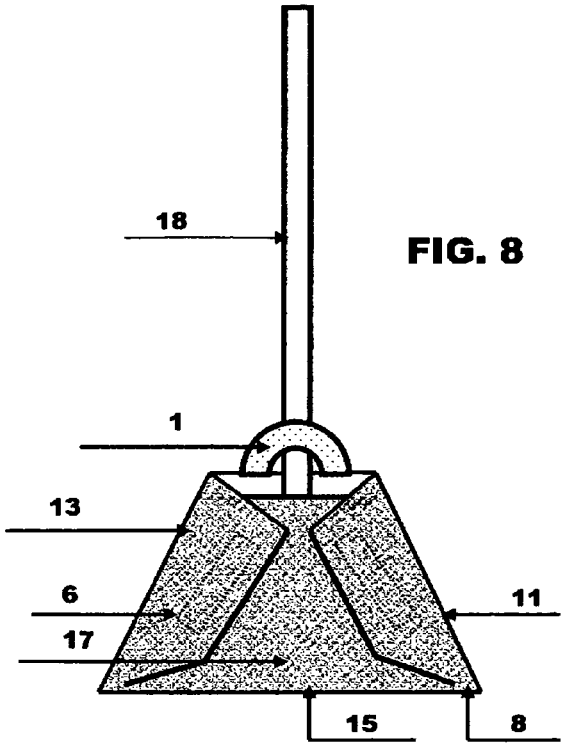
FIG. 8
FIG. 9
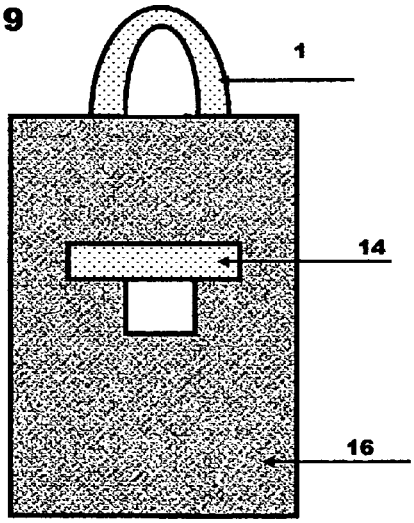
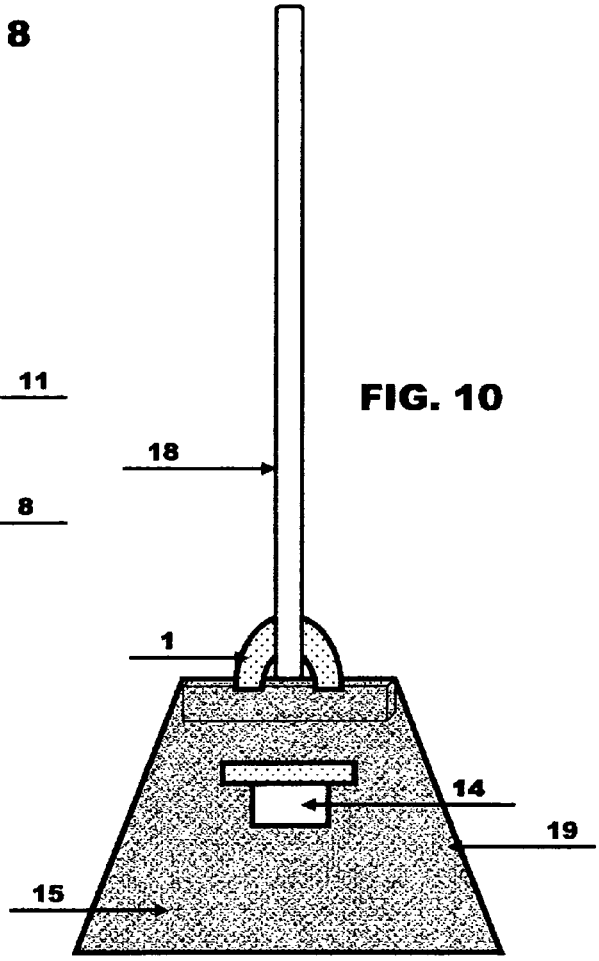
FIG. 10

MICROFIBER SWEEP MOPCLOTH CLEANING DEVICE

CROSS-REFERENCE TO RELATED APPLICATION

This application claims the benefit of U.S. Provisional Patent Application Ser. No. US60/960,229 Filed Sep. 20, 2007

BACKGROUND OF THE INVENTION

1. Field of the Invention

The present invention relates to a microfiber sweep mopcloth cleaning device. More specifically, the invention handsomely affixes to an ordinary nylon household broom with a custom, tailored fit; allotting a sweep cleaning performance never dreamed possible that saves time, energy, money, sanity and the environment, and ultimately brings joy and delightful pleasure, to the sometimes drudgery tasks of housekeeping.

2. Description of the Related Art

Cleaning surfaces, and their textures have changed dramatically through the years and have required "new" ideas for cleaning tools and methods to accommodate satisfying results that will bring joy and satisfaction to the world of housekeeping.

With all the new technology and today's ever changing world, of building materials, cleaning products and modern conveniences for some it has posted new challenges to come up with "new" cleaning products and devices to effectively clean efficiently and meticulously.

The tasks of cleaning and sanitizing in past times also presented challenges. Inventors along with every day housekeepers having to continually come up with innovative ways to improvise and make their job a little easier when it came to housekeeping tasks to save time and energy and still have satisfying results.

The challenge of sweeping or mopping a smooth floor, or applying a wax or polishing agent or dusting a wall or ceiling; covering a broom with different types of cleaning cloths, and taking advantage of the stiff broom bristles to scrub and clean along with the long handles for reaching has been an on going practice through the years.

U.S. Pat. No. 960,158, issued May 31, 1910 to Mames G, Cummings and John Lynch, discloses improvements in broom covers or covers adapted to be slipped over the head of an ordinary house broom, for brushing walls, ceilings, floors and the like, where it is not desired to use the straw working portion of the broom.

U.S. Pat. No. 1,061,486, issued May 13, 1913 to Amanda McDonald discloses the invention to provide a novel article to be attached to a broom by which a cloth may be easily positioned and positively help around the sweeping end of the former, to adapt it for cleaning and dusting walls and ceilings and for sweeping smooth floors.

U.S. Pat. No. 1,080,572, issued Dec. 13, 1913 to Amanda McDonald relates to the object of the invention is to provide a novel, easily applied and exceedingly simple article to be detachably combined with a broom and in the use of which a cloth of any character may be readily assembled with the broom head and held around the sweeping and thereof, to adapt it for cleaning and dusting walls and ceilings, for sweeping smooth floors, or for applying a polishing agent thereto.

U.S. Pat. No. 1,339,767, issued May 11, 1920 to D. R. Kelly, stating that the ordinary corn broom is not well adapted for such purposes as sweeping hardwood floors or dusting walls, and my object is to devise an attachment to the broom which will perfectly adapt it for the sweeping and dusting of hard smooth surfaces.

U.S. Pat. No. 2,288,592, issued Jul. 7, 1942 to Maybelle L. Mirhige consists of a broom apron adapted for use in cleaning different surfaces, the apron being reversible to effect a complete cleansing operation notwithstanding the surface structure and without undue wear on the apron.

U.S. Pat. No. 2,293,461, issued Aug. 18, 1942 to J. Gougeon relates to sheaths for covering an ordinary broom, said sheaths being removable and being provided with several layers of soft textile material to serve the function of a mop for wiping floors, walls, furniture and the like.

U.S. Pat. No. 2,709,824, issued Jun. 7, 1955 to Barbara Vallo Hall, relates to dust mops and more particularly to such mops which are secured to brooms and cover the brush part thereof.

U.S. Pat. No. 2,815,521, issued Dec. 10, 1957 to Louise E. Winckler, relates to a launderable envelope or cover for a dust mop and has for one of its objects the provision of a more efficient cover than heretofore, and one that will retain its effectiveness through repeated launderings and which is provided with means for insuring a flat contact between the cover and floor along a straight outer edge that terminates in corners that are adapted to clean in room corners and crevices. A still further object of the invention is the provision of an envelope for a dust mop that includes means for supplying moisture to one edge of the cover flat along said edge yet permitting flexibility so that said edge will conform to the shape of obstructions, such as the legs of furniture, floor buttons, etc.

U.S. Pat. No. 2,963,731, issued Dec. 13, 1960 to James M. Hoots, another object of this invention to provide a cleaning c over which is formed of textile material in a simple and economical manner and which does not have strings or the like attached thereto, whereby the cover may be readily laundered in home washing machines and the like.

U.S. Pat. No. 3,166,775, issued Jan. 26, 1965 to William Cushman, relates to a cushion type mop with disposable cover and it consists in the combinations, constructions and arrangements of parts hereinafter described and claimed.

U.S. Pat. No. 3,462,790, issued Aug. 26, 1969 to Ruth Lingle, a terry cloth for converting a broomhead to a mophead, the ends of the cover being in gathered stretchable condition so that the cover can be doubled over and stretched to fit various widths of broomheads. Snap fasteners are provided to hold the cover on the broomhead.

U.S. Pat. No. 6,389,637, issued May 21, 2002 to Leona Hurrell, as an alternative, a one-way stretch elastic strip may be substituted for the multi-dimensional elastic spandex. The sides of the cover are left open and unstitched to allow very easy insertion of the broom. Because the broom bristles are flexible with the fabric pouch, more fabric surface is allowed to have contact with the surface to be cleaned.

Patent Number CA2069062, issued Nov. 21, 1992 to Emory Edward P present invention provides a sanitary, economical, and effective system for the cleaning and mopping floors utilizing the present accessory.

However, none of the relevant art discloses a microfiber sweep mopcloth cleaning device which is a microfiber cloth affixed with a single fabric strap loop and two Velcro® strips that allows for a custom, tailored, tight and secure fit that keeps a broom, a broom, and offers the ability to adjust to a contoured fit for almost any size, angle or design of an ordinary nylon household broom.

None of the above inventions and patents, taken either singly or in combination, is seen to describe the instant invention as claimed.

SUMMARY OF THE INVENTION

The present invention relates to a microfiber sweep mopcloth cleaning device. More specifically, the invention is a square, soft microfiber terry cloth, assembled with a single, fabric strap loop and two Velcro® strips, that handsomely affixes to an ordinary nylon household broom which gives an adjustable custom, tailored fit; allotting a sweep cleaning performance never dreamed possible without fear of twisting, shifting or falling off; that saves time, energy, money, sanity and the environment.

The present invention ultimately brings joy and delightful pleasure, to the task of housekeeping making it fun and adictive.

It is an object of the invention to provide improved elements and arrangement thereof in the microfiber sweep mopcloth cleaning device for the purposes described which is economical, dependable and fully effective in accomplishing its intended purposes.

The invention of the microfiber sweep mopcloth cleaning device DOES NOT CHANGE A BROOM INTO "A MOP", but keeps the BROOM, "A BROOM" and completely enhances the possible cleaning tasks that the broom was never intended to perform alone, and does it effectively, with ease and satisfaction.

In these modern times, the broom has been criticized for not performing effectively and therefore has been taken out of the "spot light" if you will. Other tools for sweeping or cleaning have been created to replace and perform the job that the broom was intended to do. But, the broom just like the fork, knife and the spoon will always be a broom and will always be there to faithfully sweep when needed.

However, the microfiber sweep mopcloth cleaning device is putting the broom back into the "spot light" and in it's rightful place. Working together the broom along with the microfiber sweep mopcloth cleaning device is now able to perform housekeeping tasks like never before. Emergency, and quick clean-ups are a joy and are performed efficiently and with great ease, beautifully, and with results never dreamed possible on surfaces such as carpets, glass, smooth wood floors, ceramic tile, cement along with the new and old surfaces we clean today.

The design of this invention has allowed the ability to completely cover all of the broom bristles firmly and securely, allowing the capability of sweeping almost any substance, whether wet, dry, greasy sticky or gooey without the fear of soiling the broom bristles and gives the broom the ability to sweep accurately and meticulously, without having to chase the dirt around.

Having complete control over dirt, dust and debris with minimal sweeping strokes is now a possibility with the microfiber device for cleaning. Because of its tight, smooth, contoured, custom, tailored fit that leaves no excess fabric hanging from the bottom or the sides of the broom. The microfiber sweep mopcloth cleaning device attaches an ordinary household nylon broom and is capable to micro sweep and clean all surfaces and textures smooth, rough or otherwise with or without cleaning agents, leaving a sanitized, lint spot and streak free, squeegee like finish, resulting in a rewarding sense of happiness and delight.

The microfiber sweep mopcloth cleaning device can be washed and dried hundreds of times keeping its attractive and handsome appearance by itself, neatly folded in a drawer or on a shelf or custom fitted to an ordinary household nylon broom, joy and satisfaction is inevitable helping to create an enjoyable experience while cleaning.

Ultimately, the microfiber sweep mopcloth cleaning device, is a "Gift for those who love to clean, and one for those who have to."

These and other objects of the present invention will become readily apparent upon further review of the following specifications and drawings.

BRIEF DESCRIPTION OF THE DRAWINGS

FIG. 8 is a perspective view of a simplified pattern of the application of the microfiber sweep mopcloth cleaning device, with the left top corner Velcro® portion of cloth pulled up and over to the back side of the now tightly covered broom head with Velcro® pressed firmly over onto the now folded front side of cloth bottom which corners are neatly tucked behind the left and right portion of broom head completely covering it's bristles and now becomes the back of the microfiber sweep mopcloth cleaning device of said invention attached to a broom.

FIG. 9 is an environmental perspective view of the microfiber sweep mopcloth cleaning device of the present invention with it's optional designer look highlighting it's over all neat appearance after being laundered many times, folded and stored neatly in a drawer or on a shelf, producing a positive and fun cleaning experience.

FIG. 10 is an environmental perspective view of the microfiber sweep mopcloth cleaning device of the present invention with it's optional designer look highlighting it's over all neat appearance, giving the broom an overall handsome form and custom contoured fit along with the transformation of turning the ordinary household broom into a meticulous, precise, detailed, accurate and I can't stop cleaning household tool saving time, money and turning the task of sweeping into a pleasant and enjoyable chore with results never dreamed possible.

Figure 1:
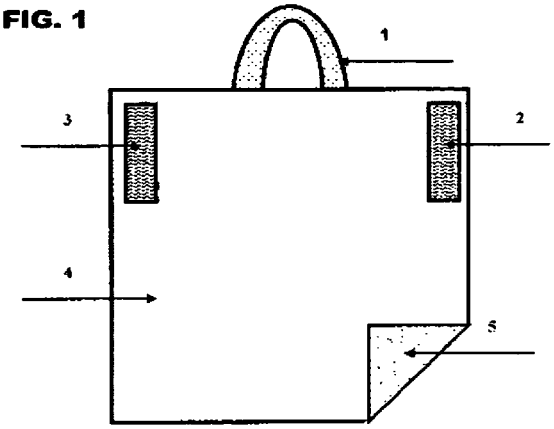
FIG. 1 is a perspective view of a simplified pattern of the application of the microfiber sweep mopcloth cleaning device with the threading of the broom handle through the fabric strap loop to assure a custom snug fit to most any size nylon household broom.
Figure 2:
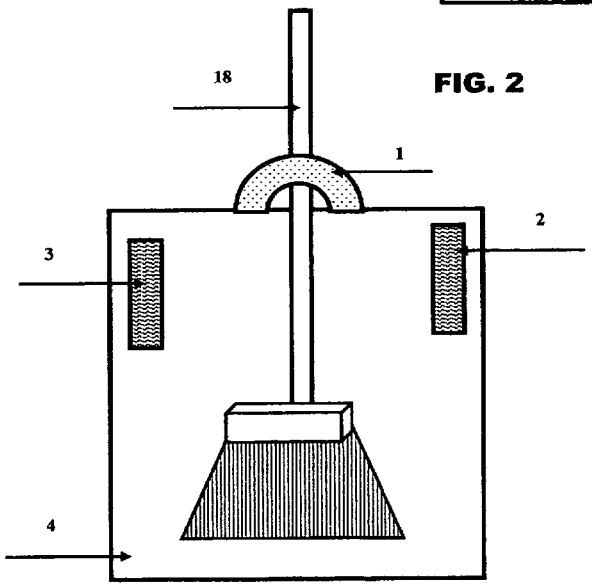
FIG. 2 is a perspective view of a simplified pattern of the application of the microfiber sweep mopcloth cleaning device with the threading of the broom handle through the fabric strap loop to assure a custom snug fit to most any size nylon household broom.
Figure 3:
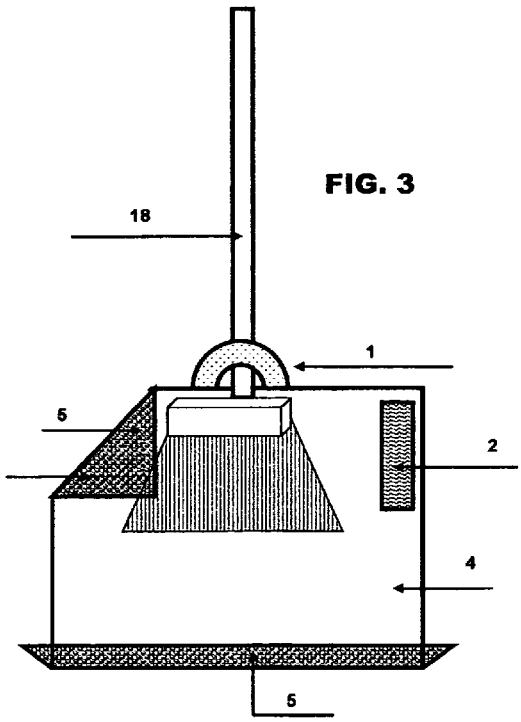
FIG. 3 is a perspective view of a simplified pattern of the application of the microfiber sweep mopcloth cleaning device with a view of the broom handle threaded through the fabric strap loop with Velcro® facing on top ready for the adjustment of the broom head for the custom tight fit of the microfiber sweep mopcloth cleaning device.
Figure 4:
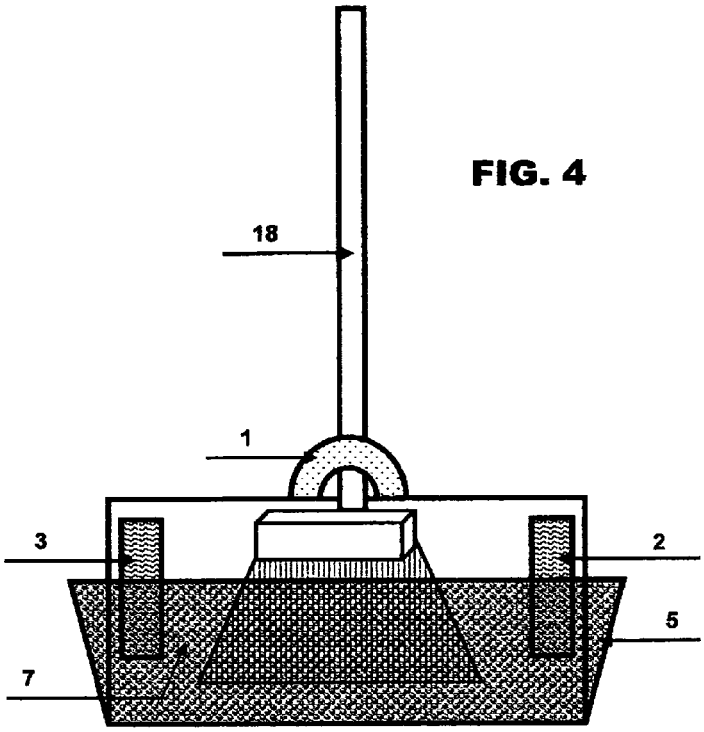
FIG. 4 is a perspective view of a simplified pattern of the application of the microfiber sweep mopcloth cleaning device, with the broom head adjusted to the top portion of the cloth closest to the fabric strap loop and the bottom portion of the cloth being pulled up and over the broom bristles.
Figure 5:
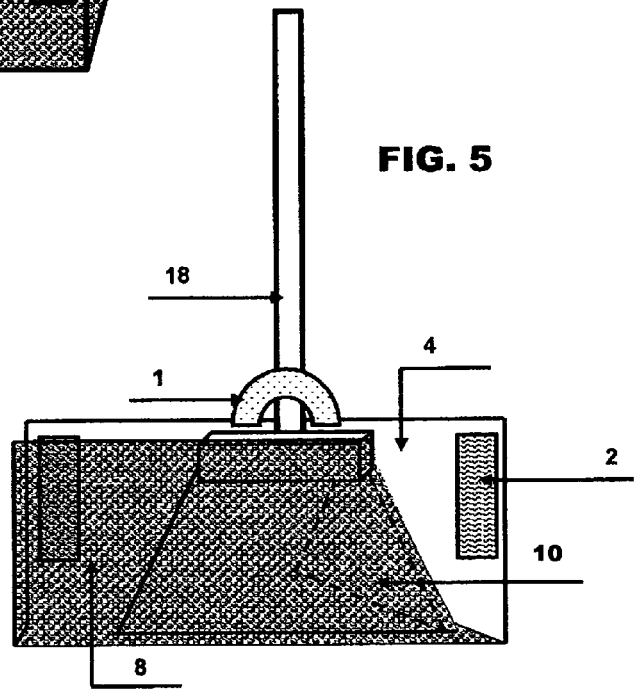
FIG. 5 is a perspective view of a simplified pattern of the application of the microfiber sweep mopcloth cleaning device, with the broom head adjusted to the top portion of the cloth closest to the fabric strap loop and the bottom portion of the cloth being pulled up and over the broom bristles with the right corner of the bottom portion of the cloth neatly and tightly tucked behind the broom bristles of the broom head.
Figure 6:
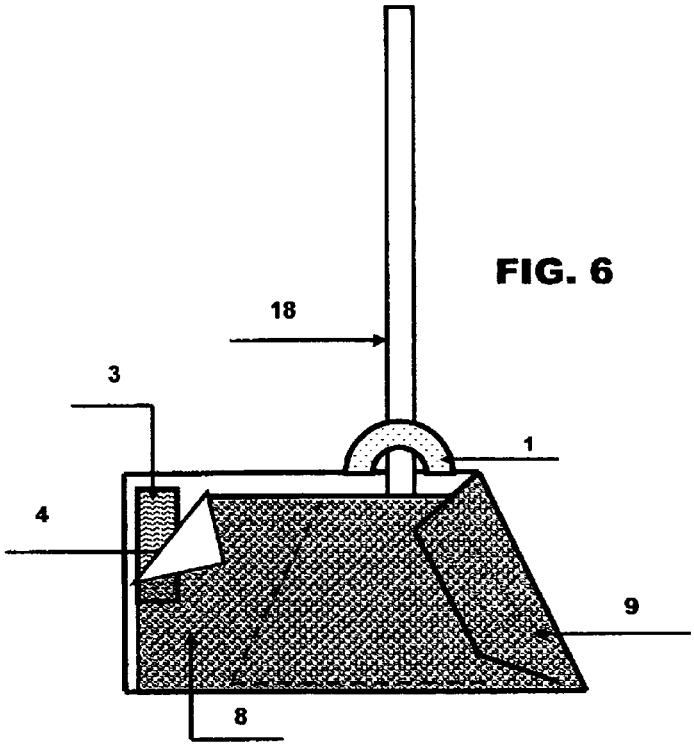
FIG. 6 is a perspective view of a simplified pattern of the application of the microfiber sweep mopcloth cleaning device, with the right top corner Velcro® portion of the microfiber sweep mopcloth cleaning device tightly pulled over to the back portion of the now covered broom head, totally enclosing all broom bristles pressing Velcro® firmly against the loop front fabric of the mopclot with the right Velcro® portion in place ready for the left bottom portion of the sweep mopcloth to be tightly tucked behind the left portion of the broom bristles of the broom head.
Figure 7:
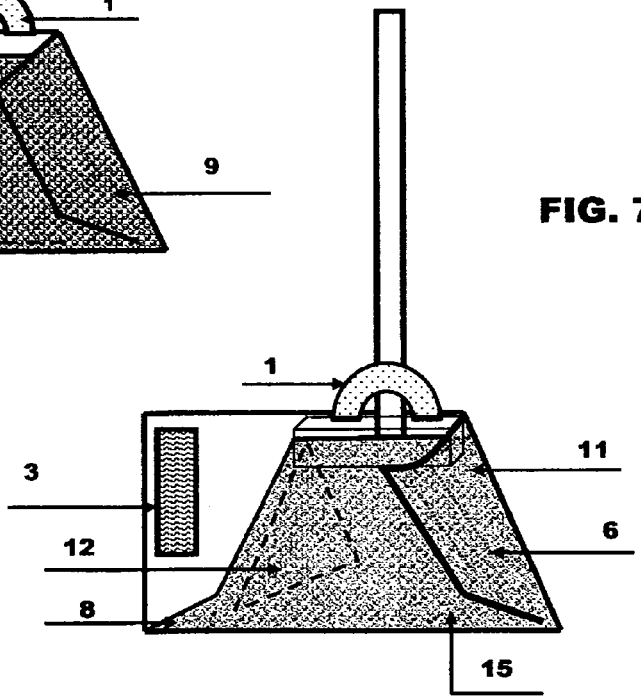
FIG. 7 is a perspective view of a simplified pattern of the application of the microfiber sweep mopcloth cleaning device, with the broom head adjusted to the top portion of the cloth closest to the fabric strap loop and the bottom portion of the cloth being pulled up and over the broom bristles with the right hand corners of the bottom portions of the cloth neatly and tightly tucked behind the broom bristles of the broom head with right Velcro® hook only, hook and loop tape pinched or pressed firmly and securely in place upon the front surface of the cloth covering the broom bristles of the broom head.

DETAILED DESCRIPTION OF THE PREFERRED EMBODIMENTS 1 fabric strap loop that allows for a perfect fit to numerous sizes of ordinary nylon household brooms simply by threading the broom handle of the said broom through the fabric strap loop opening and if desired the twisting of the fabric strap loop once around will offer a smaller opening if needed for smaller sizes and different designs of brooms and their handles to assure a firm, and secure fit to eliminate any shifting or falling off of the said invention microfiber sweep mopcloth cleaning device.

2 right Velcro®, hook side only, tape or disposable or otherwise adhesive product, wherein the microfiber terry or other loop fabrics or disposable paper receives the hook side only of the Velcro®, tape or disposable and otherwise adhesive, strip or desired sectional shape or portion of the adhesive apparatus with the ability to adjust to a perfect fit for numerous size brooms that give a custom and contoured fit of the said invention.

3 Left Velcro®, hook side only, tape or disposable or otherwise adhesive product, wherein the microfiber terry or other loop fabrics or disposable paper receives the hook only side of the Velcro®, tape or disposable and otherwise adhesive, strip or desired sectional shape or portion of the adhesive apparatus with the ability to adjust to a perfect fit for numerous size brooms that give a custom and contoured fit of the said invention.

4 back side of microfiber fabric of the said invention.

5 front side of microfiber fabric of the said invention.

6 Velcro® strip, hook side only stitching.

7 front bottom side about to go over broom broom head bristles.

8 custom fit completely covering bristles of a broom head.

9 right top back side of cloth adjusted with Velcro® pressed or pinched firmly over and adjacent to the now folded front side of cloth (folding twice for shorter bristles), which corners are then neatly tucked behind the right portion of broom head and its bristles and now becomes the back of the microfiber sweep mopcloth cleaning device of said invention.

10 right bottom corner of back side of cloth pulled up over broom bristles and tucked behind back side of broom head one side at a time of the said invention.

11 right top back side of cloth adjusted with Velcro® pressed or pinched firmly over and adjacent onto the now folded front side of cloth which corners are neatly tucked behind the right portion of broom head, completely covering its bristles and now becomes the back of the microfiber sweep mopcloth cleaning device of said invention.

12 left bottom corner of back side of cloth pulled up over broom bristles and tucked behind back side of broom head one side at a time.

13 left top back side of cloth adjusted with Velcro® pressed firmly over onto the now folded front side of cloth which corners are neatly tucked behind the left portion of broom head, completely covering its bristles and now becomes the back of the microfiber sweep mopcloth cleaning device of said invention.

14 optional designer appearance of the said invention.

15 tight custom fit of the said invention.

16 handsome appearance either folded neatly and stored in a drawer or on a shelf or custom fitted to the contoured shape of an ordinary nylon household broom on-call waiting to sweep.

17 backside of a broom attached with a microfiber sweep mopcloth cleaning device of the said invention.

18 broom handle.

19 example of one optional designer look of an ordinary, nylon, house hold broom with a fabric strap loop and hook side only of two Velcro® strips are permanently attached directly to the microfiber terry cloth or any other said cloth either by stitching or by strong adhesive and is not limited to any said fiber, or width and length of Velcro, or disposable adhesive product.

It is to be understood that the microfiber sweep mopcloth cleaning device of the present invention is not limited to the embodiments described above, but encompasses any and all embodiments within the scope of the following claims.

What is claimed is:

1. A Microfiber Sweep Mopcloth cleaning device comprising:

an attachment structure configured to fixedly adhere and provide for a secure taut fit to a handle portion of a cleaning tool; said attachment structure including an at least four-sided microfiber primary cleaning cloth member; a fabric loop collar attached along a top side portion of said primary cleaning cloth member; and at least two "hook portion" members of a hook and loop attachment material attached to said primary cleaning cloth member.

2. A Microfiber Sweep Mopcloth cleaning device according to claim 1, wherein said primary cleaning cloth member has four sides comprising a top and bottom side portion and a right and left side portion, and further having a front and back portion.

3. A Microfiber Sweep Mopcloth cleaning device according to claim 2, wherein said front and back portion of said primary cleaning cloth member is microfiber which includes a loop-like woven texture serving as the corresponding "loop portion" member of said hook and loop attachment material to adhere and cling to said "hook portion" members.

4. A Microfiber Sweep Mopcloth cleaning device according to claim 1, wherein said fabric loop collar is comprised of a strong non-stretch woven fabric or lanyard material extending out and permanently fixed in a stationary position located in the center of said top side portion of said primary cleaning cloth member; and said fabric loop collar then receives a handle portion of a cleaning tool and glides over and down toward the bottom of said handle portion securing a locking position.

5. A Microfiber Sweep Mopcloth cleaning device according to claim 1, wherein said at least two "hook portion" members of said hook and loop attachment material are located along upper, outside edges of the right and left side portions of said primary cleaning cloth member; and said at least two "hook portion" members of said hook and loop attachment material randomly adhering against various locations of said corresponding "loop portion" member of said primary cleaning cloth.

6. A Microfiber Sweep Mopcloth according to claim 1, wherein said fabric loop collar along with at least three portion segments of said primary cleaning cloth member is coupled together with a safety pin for vigorous sweeping tasks.

* * * * *